United States Patent [19]

Togashi

[11] Patent Number: 4,626,841

[45] Date of Patent: Dec. 2, 1986

[54] METHOD OF DRIVING MATRIX DISPLAY DEVICE

[75] Inventor: Seigo Togashi, Tokorozawa, Japan

[73] Assignee: Citizen Watch Company Limited, Tokyo, Japan

[21] Appl. No.: 536,106

[22] Filed: Sep. 26, 1983

[30] Foreign Application Priority Data

Sep. 27, 1982 [JP] Japan ..... 57-167943

[51] Int. Cl.[4] ..... G09G 3/00

[52] U.S. Cl. ..... 340/805; 340/784

[58] Field of Search ..... 340/713, 714, 718, 719, 340/783, 784, 811, 805; 357/10, 13, 15, 38, 45, 48, 51

[56] References Cited

U.S. PATENT DOCUMENTS

| | | | |
|---|---|---|---|
| 3,654,606 | 4/1972 | Marlowe et al. | 340/784 X |
| 3,936,676 | 2/1976 | Fujita | 340/784 X |
| 4,050,064 | 9/1977 | Hashimoto et al. | 340/784 X |
| 4,198,630 | 4/1980 | Serinker et al. | 340/784 |
| 4,223,308 | 9/1980 | Baraft et al. | 340/784 X |
| 4,233,603 | 11/1980 | Castleberry | 340/784 X |
| 4,251,136 | 2/1981 | Miner et al. | 340/719 X |
| 4,288,805 | 9/1981 | Depey | 357/48 X |
| 4,373,166 | 2/1983 | Bergeron et al. | 357/13 X |
| 4,393,380 | 7/1983 | Hosokawa et al. | 340/784 X |
| 4,403,217 | 9/1983 | Becker et al. | 340/784 X |

*Primary Examiner*—Ulysses Weldon
*Assistant Examiner*—Vincent P. Kovalick
*Attorney, Agent, or Firm*—Jordan and Hamburg

[57] ABSTRACT

A method of driving a matrix display device in which each display element (e.g. a liquid crystal display element) is connected in series with a non-linear resistance element, utilizing row scanning signals which vary periodically between 4 different potentials, the potentials being selected such that an alternating bias potential is applied to each display element both in the non-activated and in the activated state thereof, and such that satisfactory operation can be attained using non-linear resistance elements having a threshold voltage which is considerably lower than has been practicable in the prior art, e.g. with the threshold voltage of a single PN junction being utilizable.

6 Claims, 21 Drawing Figures

$$F = \frac{V_{th}}{V_{ON}}$$

$$D = \frac{(dV_{ON}/V_{ON})}{(dV_{th}/V_{ON})}$$

$$G = \frac{V_{PP}}{V_{ON}}$$

S1
S2
S3
φ1*
φ2*
φ3*
Va
Vb
-Vb
-Va
92
H1
I1
J1
K1
H2
I2
J2
K2
H3
I3
J3
K3
90
C
A1
A2
A3
88
Ta
Tb
TS
86

METHOD OF DRIVING MATRIX DISPLAY DEVICE

BACKGROUND OF THE INVENTION

The present invention relates to a method of driving a matrix display device of the type in which each matrix element comprises a series-connected combination of a non-linear element and a display element such as a liquid crystal display element. More specifically, the present invention relates to a drive method whereby non-linear elements having a low value of threshold potential can be used, while maintaining a sufficiently large operating margin to allow for manufacturing deviations in element characteristics. Various types of matrix display devices, utilizing a liquid crystal, electro-chromic or other types of display element, have now reached the stage of practical application, and methods are now being considered for producing high-density matrix displays. In general, the most satisfactory drive method which has been developed until now for such displays has been the "active matrix" method, in which active elements (e.g. thin-film FET transistors) are employed to control the display elements, with one active element being provided for each display element and formed on a display panel closely adjacent to the corresponding display element. This active matrix drive method is satisfactory from the aspect of providing a sufficiently high tolerance against the effects of stray deviations in the characteristics of the display elements and the active elements themselves to ensure reliable operation. Such an active matrix display, utilizing transistors as control elements, has been described for example by B. J Leichner et al in a report published in the Proceedings of the IEEE, volume 59, No. 11, pages 1566 to 1579.

However it is desirable to simplify the configuration of all of the elements of a matrix display as far as possible, in order to ensure maximum manufacturing yield, and to maximize the available display area as far as possible, both by minimizing the area occupied by the control elements and that occupied by connecting leads coupled to these control elements (e.g. the connecting leads to the gate electrodes of transistors used as control elements). For this reason, it has been proposed to utilize a "active matrix" type of display, in which active elements, i.e. 2-terminal devices having a suitably non-linear voltage/resistance characteristic, are used as control elements. Such a method has also been described by Leichner et al in the above reference. It has been proposed to use ceramic varistors as such non-linear control elements, for example as described by D. E. Castleberry in the IEEE ED-26, 1979, pages 1123 to 1128. In addition, it has been proposed to use MIM type diodes for such non-linear elements, for example as described by D. R. Baraff et al, in the IEEE ED-28, 1981, pages 736 to 739.

However, various problems have arisen with such prior art proposals for utilizing active elements. These are:

1. Lack of uniformity in element characteristics.
2. Operation of the display can be strongly affected by the distribution pattern of element characteristics, and by stray deviations in these characteristics.
3. The threshold potential Vth of the elements must be high.
4. The drive voltage levels required are high.

The most serious disadvantage of these prior art proposals has been that it is necessary to use active elements having a high level of threshold voltage, in spite of the fact that some types of display element such as liquid crystal display elements can operate at drive voltage levels as low as two or three volts. Elements having an inherently high value of threshold voltage, such as varistors or zener diodes, are not suited to formation on display matrix panels, e.g. in the form of thin-film elements closely adjacent to display elements, and in addition elements such as varistors have a considerable stray deviation in their threshold voltage values. In addition, it is desirable that such a matrix display device can be operated from a low value of supply voltage, to facilitate use in portable equipment, so that a requirement for high drive voltage levels is a significant disadvantage.

With the present invention, a new drive method is employed, whereby the disadvantages 2, 3 and 4 above are considerably reduced, and whereby it becomes possible to use elements which have a low value of threshold potential, so that disadvantage 4 is substantially eliminated. Thus, the method according to the present invention enables the threshold voltage (in the forward conduction direction) of a single PN diode to be utilized to control each display element, so that a suitable non-linear element can be configured as a pair of PN diodes connected in parallel with opposing polarities. Such diodes have a much higher degree of stability and uniformity of characteristics than the devices such as MIM diodes or varistors which have been previously proposed for use an non-linear elements in matrix display devices. In this way, the present invention considerably reduces problem (1) above, and brings such displays significantly closer to the stage of practical application.

SUMMARY OF THE INVENTION

The drive method of the present invention is applicable to a matrix display device comprising a set of row electrodes and a set of column electrodes disposed to mutually intersect, and an array of matrix elements, each comprising a display element such as a liquid crystal display element connected in series with a non-linear resistance element between a row electrode and column electrode, i.e. with the matrix elements being disposed at corresponding intersections of the row electrodes and column electrodes. Drive signals, referred to in the following as row scanning signals, are applied successively to the row electrodes such as to sequentially address the rows of the matrix during periodically repeated frame intervals, i.e. with all of the rows being successively scanned during each frame interval, with the absolute value of an row scanning signal attaining a maximum value within a frame during a selection interval. At the start of a selection interval, the polarity of the row scanning signal is inverted, and upon completion of the selection interval, i.e. upon initiation of an immediately succeeding non-selection interval the row scanning signal goes to a potential whose absolute value is lower than that during the preceding selection interval and whose polarity is the same as that during the preceding selection interval. The row scanning signal remains at that potential until initiation of the next selection interval, during the next frame interval. The polarity of the row scanning signal is then inverted once more, and the above process is successively repeated.

It can thus be understood that with the drive method of the present invention, each row scanning signal varies between four different potential levels. Drive signals, referred to in the following as data signals, are applied to the column electrodes. The data signals vary between predetermined maximum and minimum potentials, with the potential of a data signal applied to a particular column varying successively in potential in accordance with data to be displayed by the display elements of that column, the data being selected by the row scanning signals during the selection intervals, i.e. with an element being set into the activated or ON state during a selection interval if the corresponding data signal is at a potential opposite in polarity to the row scanning signal and of sufficient absolute magnitude within that selection interval. Due to the specific waveform of row scanning signal utilized with the drive method of the present invention, a bias voltage which alternates in polarity during successive frame intervals is applied across each display element, both when the display element is activated and when it is in the non-activated state. This has not been reliably achieved with prior art drive methods for matrix display devices using passive control elements, and is an essential feature to ensure satisfactory operation and a long operating life when liquid crystal display elements are utilized.

By suitably selecting the potentials of the row scanning signals during the selection intervals and non-selection intervals, a sufficiently high level of operating margin can be obtained, (where the operating margin is defined as the ratio of the potential applied across a display element when it is in the activated state to the potential applied across the display element when it is in the non-activated state), using non-linear resistance elements having a very low level of threshold voltage, e.g. of the order of 0.7 V such as the threshold voltage of a silicon diode during forward conduction.

In addition, the drive method of the present invention provides a higher degree of tolerance with respect to manufacturing deviations in the characteristics of the display elements and non-linear resistance elements than is provided with prior art drive methods. This, combined with the capability for utilizing elements having a low value of threshold voltage such as silicon diodes as non-linear resistance elements, and the greatly reduced drive voltage level requirements of the drive method according to the present invention, considerably facilitate the practical implementation of high-density large-size matrix display devices which can be manufactured at low cost, and which will provide a display capability comparable to that obtainable by using active elements as control elements of the matrix.

DESCRIPTION OF THE PREFERRED EMBODIMENTS

Figure 1:
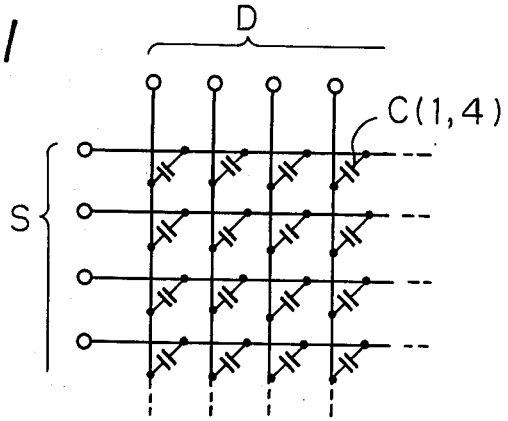
FIG. 1 is a diagram illustrating the basic configuration of a matrix display device.

Before describing an embodiment of the present invention, a simple description will be given of a prior art display drive method. FIG. 1 is a diagram illustrating the general configuration of a matrix type of display device. In the diagram, S denotes a plurality of row electrodes, D denotes a plurality of column electrodes, with display elements C being disposed at positions corresponding to the intersections of these row electrodes and column electrodes. For convenience of description, it will be assumed in this specification that scanning signals are always applied to the row electrodes, to successively select rows of display elements such that the display elements within a selected row are either set into an activated state or left in a non-activated state, in accordance with the states of data signals applied to the column electrodes during a selection interval. The complete set of rows is scanned during a time interval which will be referred to as a frame interval, and in general the state of activation or non-activation of each display element will be memorized by the element itself, i.e. as a charge stored in the inherent capacitance of the element or in an auxiliary capacitor coupled thereto.

Figure 2:
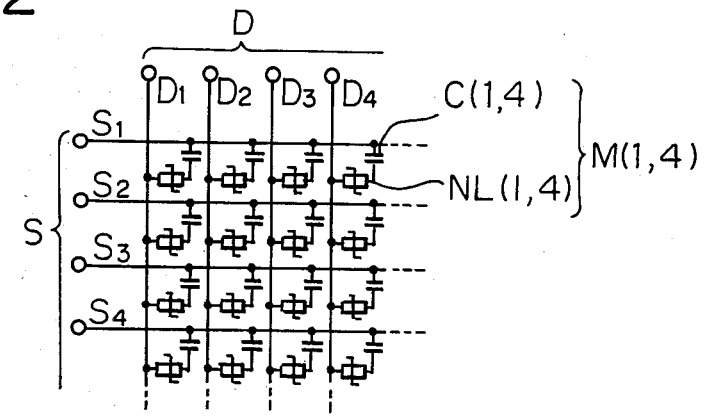
FIG. 2 is a diagram illustrating the basic configuration of a matrix display device utilizing non-linear resistance elements as active control elements.
Figure 3:
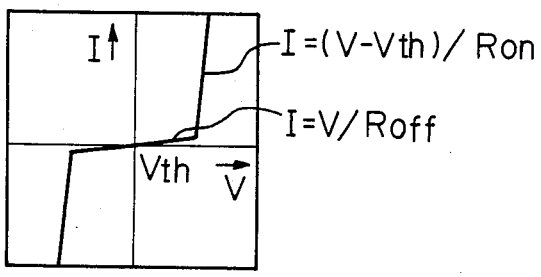
FIG. 3 is a graph showing the general form of the voltage-current characteristic of a non-linear resistance element for use in a matrix display device.

FIG. 2 is a diagram for describing a matrix type of display device in which non-linear elements (i.e. non-linear resistors) 2 are used to control the selection of the display elements during the corresponding selection intervals. Here, each of matrix elements M comprises a non-linear element L and display element C connected in series between a row electrode and column electrode at the intersection thereof. The voltage/current characteristic of an idealized non-linear element is shown in simplified form in FIG. 3. As shown, the characteristic displays two different values of resistance Roff and Ron, at voltages above and below the threshold potential Vth.

Figure 4:
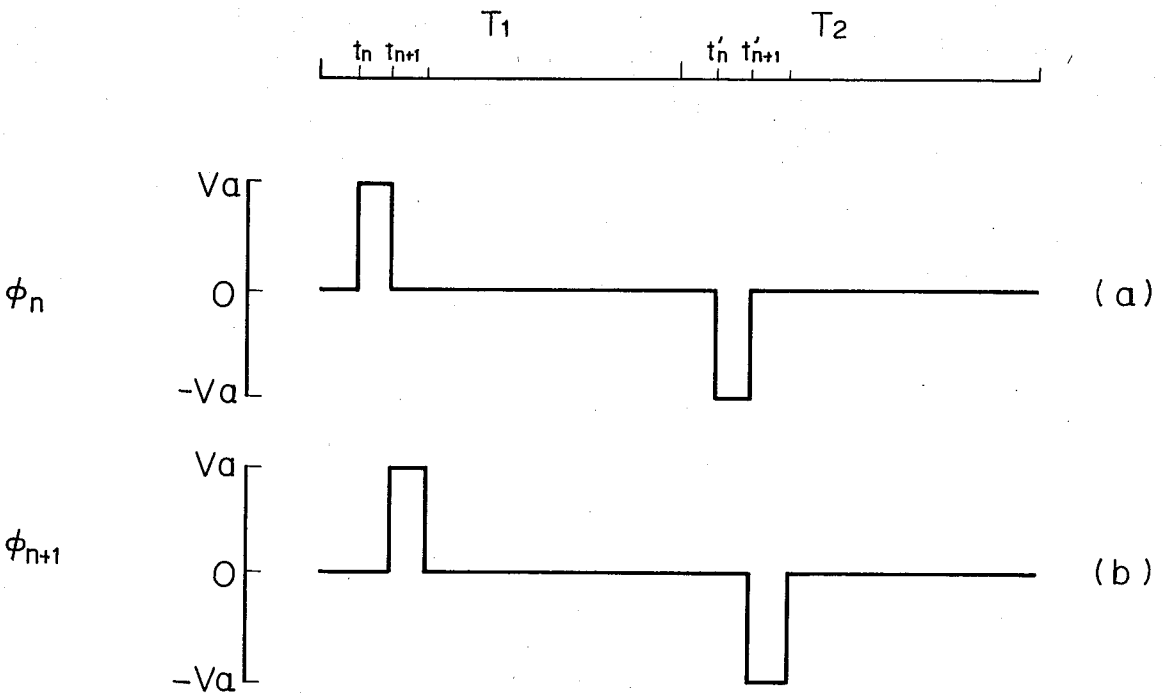
Fig. 4 PRIOR ART
FIG. 4 and FIG. 5 are respectively waveform diagrams illustrating drive signal waveforms of first and second prior art drive methods for a matrix display device.
Figure 4:
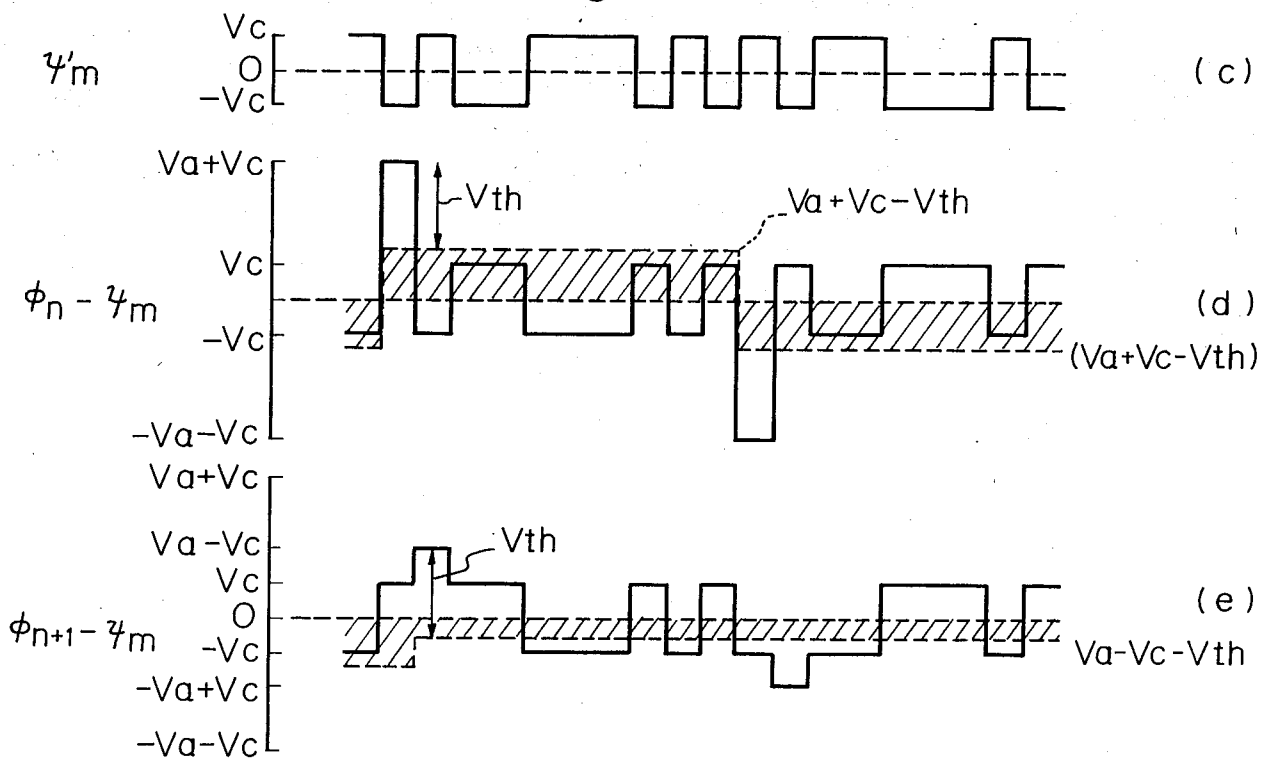
Fig. 4 PRIOR ART

FIG. 4 shows examples of drive signal waveforms for a prior art method of driving such a matrix display device. T1 and T2 denotes two successive frame intervals, with all of the rows of the matrix being successively scanned during a frame interval by row scanning signals. This drive method is intended for use with liquid crystal display elements, and for this reason the polarity of the row scanning signal pulses are inverted in successive frame intervals, with the polarity of the data signals being correspondingly inverted. $\phi_n$ and $\phi_{n+1}$ are row scanning signal pulses which are successively applied to row electrodes $S_n$ and $S_{n+1}$ respectively. During frame interval T1, signal $\phi_n$ goes to the selection potential Va during a selection interval tn, and remains at 0 potential at all other times. Similarly, signal $\phi_{n+1}$ goes to selection potential Va during selection interval Tn+1 within frame interval T1, and remains at the 0 potential at all other times. During frame interval T2, signal $\phi_n$ goes to the selection potential −Va during time interval tn, and is at the 0 potential at all other times, while similarly, signal $\phi_{n+1}$ goes to the selection potential −Va during time interval $t'_{n+1}$ within frame interval T2, and is at the 0 potential at all other times.

Ym denotes a data signal which is applied to column electrode Dm. The potential of this signal varies between potentials Vc and −Vc, as shown in FIG. 4(*a*). During frame interval T1, Vc is the activation potential of the data signal, (i.e. if the data signal applied to a column electrode is at that potential during a selection interval, then a sufficiently high potential will be established across the corresponding display element to activate it) and −Vc is the non-activation potential (i.e. if the data signal on a column electrode is at that potential during a selection interval, then the potential established across the corresponding display element will be sufficiently low that the corresponding display element will be left in the non-activated state). However during the immediately succeeding time interval T2, −Vc is the activation potential and Vc is the non-activation potential, since the polarity of the row scanning signal is inverted in successive frame intervals.

Thus, a potential difference $(\phi_n-\psi_m)$ is applied to matrix element $M_{m,n}$ i.e. the matrix element at the intersection of the nth row and the mth column, this potential being indicated by the full-line portions in FIG. 4(*d*). The hatched-line portions in FIG. 4(*d*) indicate that the display element is held in the ON, i.e. activated state.

If a specific condition, designated as condition (1) below, is met, then the signal which is applied to the corresponding display element $C_{m,n}$ will be as indicated by the broken-line portion in FIG. 4(*d*). That is to say, the potential which is applied to that display element is held at (Va+Vc−Vth) from ($t_n$ to $t_n'$), which will be designated as the ON potential and will be assumed to be sufficiently high to hold that display element in the activated state, and is held at (−Va+Vc−Vth) during the time interval from $t_n'$ to the next selection interval. In order to ensure that, for example, during frame interval T1 the potential across the display element does not fall below the level indicated by the broken-line outline when the data signal goes to −Vc, it will obviously be necessary that the threshold voltage Vth be equal to or greater than a potential (Va+Vc−Vth)+Vc. Thus, in order to ensure that this display element is held in the activated state, the following condition must be satisfied:

$$Vth \geqq (Va+2Vc) \quad (1)$$

A signal potential $(\phi_{n+1}-\psi_m)$, indicated by the full-line portions of FIG. 4(*e*), is applied to matrix element $M_{n+1,m}$ while the signal represented by the broken-line portions of FIG. 4(*e*) is applied to display element $C_{n+1,m}$. The hatched-line portions of FIG. 4(*e*) correspond to the OFF signal state. As stated in prior art reference 2 above, it is necessary for the following condition (which will be referred to hereinafter as condition (2)), to be satisfied:

$$(Va-Vc)<Vth \quad (2)$$

However, as shown in FIG. 4(*e*), a single polarity of potential is maintained across the display element after it has been set in the non-activated state, so that the operation will not be satisfactory for certain types of display element such as liquid crystal display elements, which require a successively alternating bi-directional polarity drive signal. The condition for providing such an alternating drive signal can be expressed by replacing condition (2) above by the following condition (3):

$$Va-Vc \geqq Vth \quad (3)$$

In this case, of course, it will be necessary to ensure that the potential applied to a non-activated display element (i.e. potential Va−Vc+Vth), referred to in the following as the non-activation potential or Voff, will always be below the minimum potential which will activate a display element.

In the following, the first prior art drive method described above will be referred to as drive method A, while a modified version of that drive method which meets condition (3) above will be referred to as drive method A*.

Figure 5:
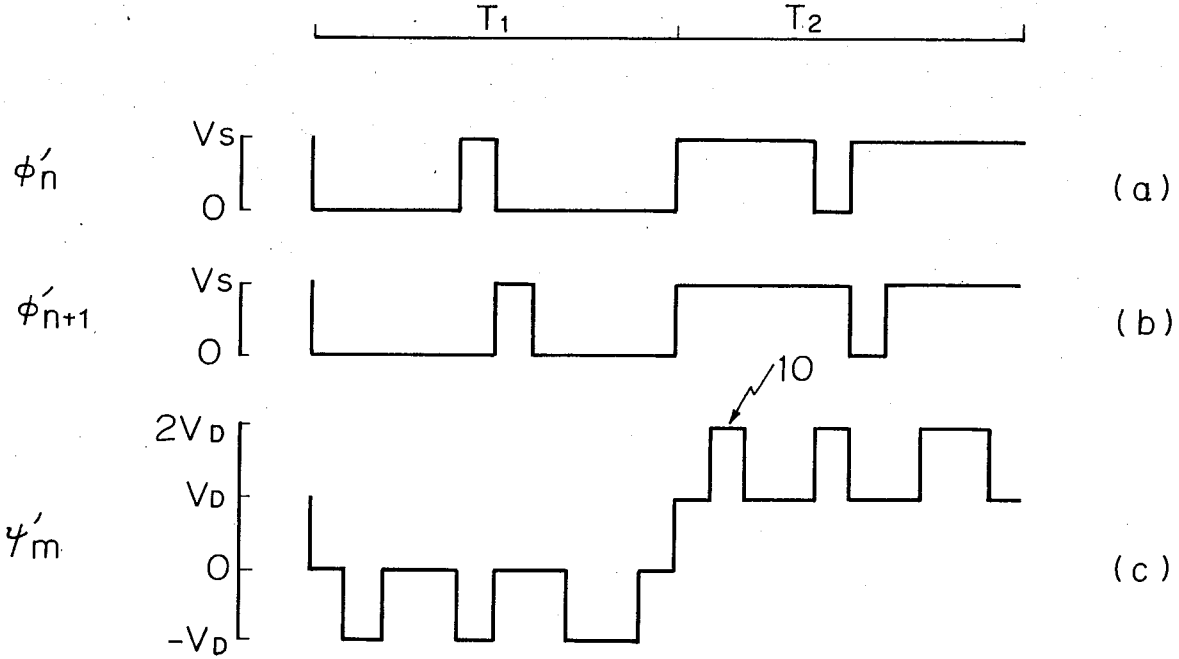
Fig. 5 PRIOR ART
Figure 5:
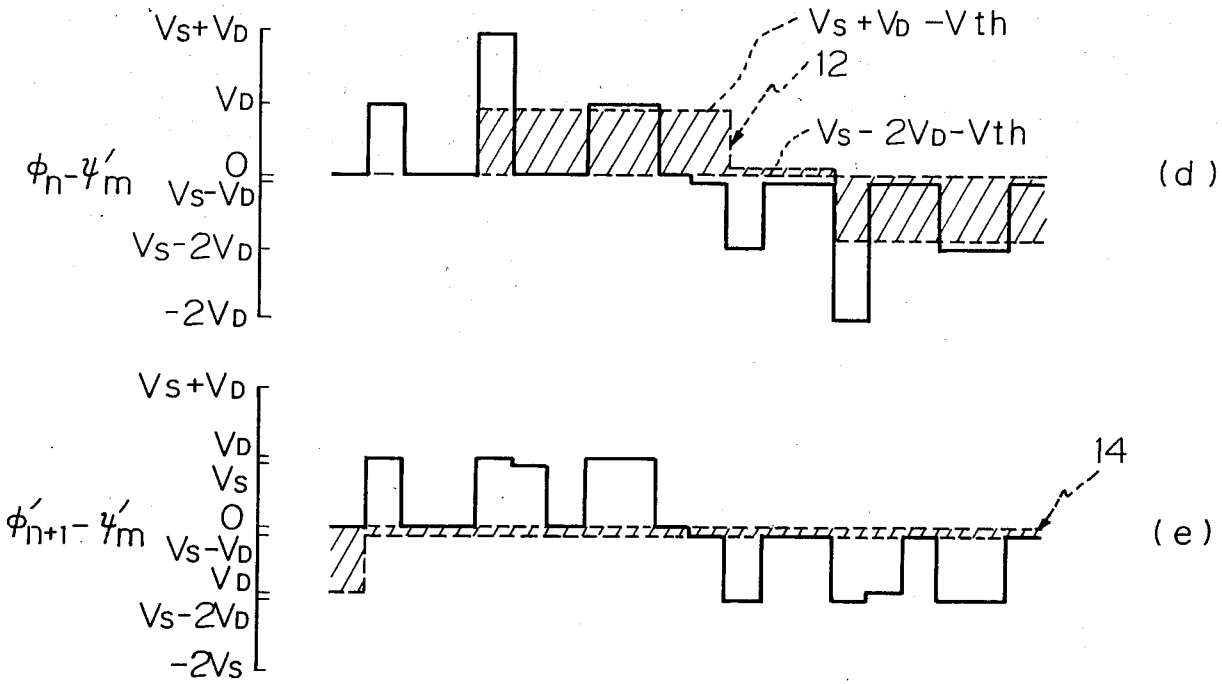
Fig. 5 PRIOR ART

FIG. 5 shows an example of drive signal waveforms for another prior art example which is described in prior art reference 2. In this case, the row scanning signals, e.g. $\phi'_n$ and $\phi'_{n+1}$, vary between the two potentials Vs and 0, i.e. going to Vs during the selection intervals of the odd-numbered frame intervals, and going to 0V in the selection intervals of the even-numbered frame intervals. The data signals, e.g. $\psi'_m$, vary between potentials 2Vd, Vd, 0 and −Vd. During the odd-numbered frame intervals, the activation potential of the data signal is −Vd, and during the even-numbered frame intervals it is 2Vd.

As described in prior art reference 2, it is necessary for the following conditions (4) to be met in order to ensure that a non-activated display element is held in the non-activated state:

$$Vd<Vth \quad (4)$$

If this condition is satisfied, then two problems will arise. Firstly, when a non-activation potential signal (for example $\phi'_{n+1}-\psi'_m$) is applied, then as indicated by numeral 14, a DC component will be introduced into the drive signal, i.e. AC symmetry is lost. Another severe problem is that a change in the potential across an activated display element, from (Vs+Vd−Vth) to (Vs31 2Vd−Vth), takes place at the timing indicated by numeral 12, following a transition from frame interval T1 to frame interval T2 (or from frame interval T2 to T1) at the timing of the first activation pulse 12 of the next frame interval T2. The specific timing of this activation potential pulse depends upon the display states of other elements in that particular column, so that the time duration for which potential (Vs+Vd−Vth) is applied to a display element will also be dependent on the display states of other elements in the column. This will introduce cross-talk and lack of uniformity of operation. These two problems cannot be resolved by changing the operating conditions, such as has been described for prior art reference A.

As described in the above, various problems arise with both the bipolar drive methods described in prior art reference A and B. However, the problems which arise with regard to prior art reference A can be resolved to some extent by changing condition (2) given in prior art reference A to condition (3), i.e. changing drive method A to drive method A*.

In addition to conditions (2), (3) and (4) described above, the following quantities D, F and G are also important in evaluating a method of driving a matrix display device. These quantities are as follows:

$$D=(dVon/Von/dVth/Vth) \quad (5)$$

$$F=Vth/Von \quad (6)$$

$$G=Vp-p/Von \quad (7)$$

In the above, Von is the effective voltage which must be applied to produce activation of a display element. Vp−p is the peak-to-peak value of the drive signal voltage. A drive margin M will also be defined, as:

$$M=Von/Voff \quad (8)$$

Here, Voff is the effective voltage which must be applied to a display element to hold that display element in the OFF state, i.e. the erased or non-activated state. The values of Von and Vth will vary from the nominal values thereof, due to manufacturing deviations, and the amounts of such deviations are designated as dVon and dVth, respectively.

The larger the value of M, the better will be the degree of control of the display elements, and hence the better will be the display quality. With drive method A*,:

$$Von=Va+Vc-Vth \quad (9)$$

$$Voff=Va-Vc-Vth \quad (10)$$

The conditions for minimizing the values of D and F are established by changing condition (1) above to an equation, i.e. setting $Vth=(Va+2Vc)/2$. The corresponding values of D, E and F for drive method A*, $D_{A*}$, $F_{A*}$ and $C_{A*}$, are given by the following equations:

$$F_{A*}=Vth/(Va+Vc-+Vth) \quad (11)$$

$$D_{A*}=F_{A*}/dVth \quad (12)$$

$$G_{A*}=2Va/(Va+Va+Vc-Vth) \quad (13)$$

By using the relationship $Vth=(Va+2Vc)/2$, the following equations can be derived:

$$D_{A*}=(3M-1)/1M \quad (14)$$

$$F_{A*}=(3M-1)/2M \quad (15)$$

$$G_{A*}=4 \quad (16)$$

Figure 7:
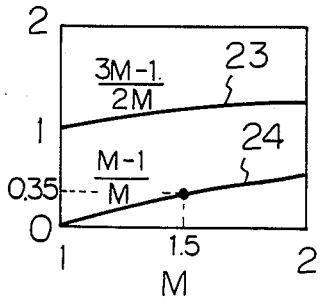
FIGS. 7, 8 and 9 are graphs for comparing optimum operating conditions of a prior art drive method and of the present invention.
Figure 8:
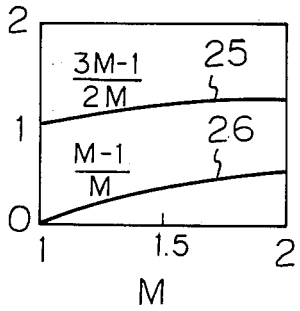
Figure 9:
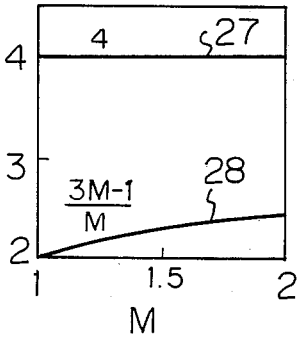

The above relationships are illustrated graphically in FIGS. 7, 8 and 9, with curves 23, 25 and 27 therein respectively showing the variation of F, D and G with respect to drive margin M, for the improved prior art drive method A*.

Figure 6:
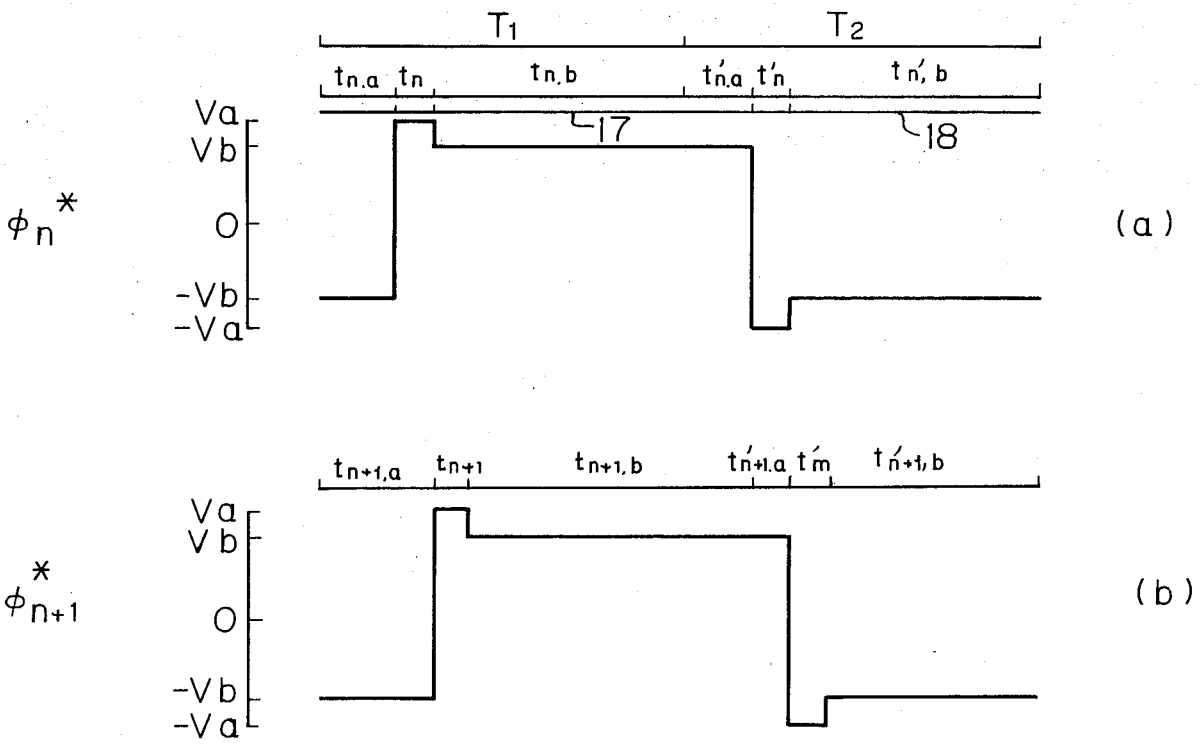
FIG. 6 is a waveform diagram illustrating drive signal waveforms for an embodiment of a drive method for a matrix display device according to the present invention.
Figure 6:
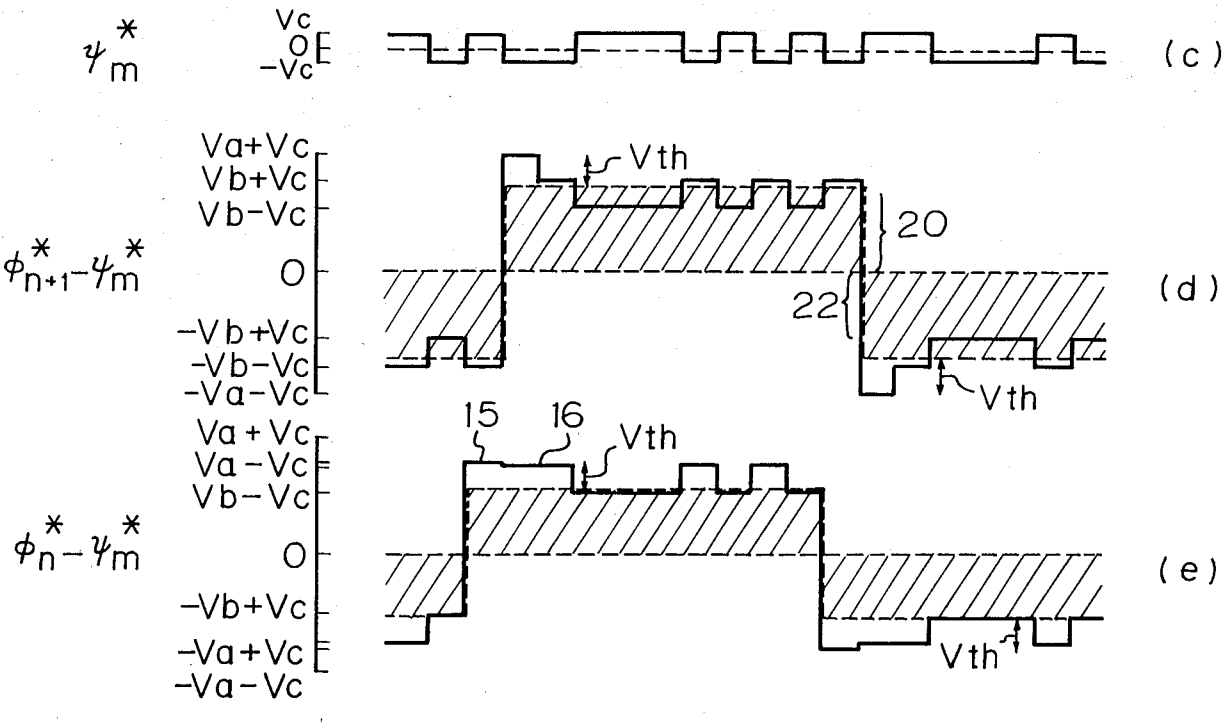

FIG. 6 shows the drive signal waveforms for a method of driving a matarix display device according to the present invention. FIG. 6(*a*) shows the row scanning signal $\phi^*_n$ applied to matrix element $M_{m,n}$, while FIG. 6(*b*) shows the row scanning signal $\phi^*_{n+1}$ applied to matrix element $M_{m,n+1}$. The row scanning signal $\phi^*_n$ goes to a potential Va during a selection interval denoted as $t_n$ in frame interval T1, goes to a potential Vb during a succeeding non-selection interval portion $t_{n,b}$ of frame interval T1, remains at potential Vb during an intitial non-selection interval portion $t'_n$ of the next frame interval T2, goes to a potential −Va during a selection interval $t'_n$ of frame interval T2, and goes to a potential −Vb during a succeeding non-selection interval portion of frame interval T2. Prior to selection interval $t_n$ of frame interval T1, this signal is at potential −Vb, i.e. the waveforms shown in FIG. 6(*a*) are successively repeated. Similarly, row scanning signal $\phi^*_{n+1}$ is at potential −Vb during an initial non-selection interval portion of frame interval T1, goes to potential Va during selection interval $t_{n+1}$ of frame interval T1, goes to potential Vb during a succeeding non-selection interval portion $t_{n+1,b}$ of frame interval T1, goes to potential −Va during selection interval $t'_{n+1}$ of the next frame interval T2, and goes to potential −Vb during the succeeding non-selection interval portion $t'_{n+1,b}$ of frame interval T2.

The data signal $Y^*_m$, shown in FIG. 6(*c*), varies between maximum and minimum potentials Vc and −Vc. In this embodiment, it is assumed that only ON and OFF display states are to be produced, however it is of course equally possible to utilize an analog type of continuously varying signal as data signal $Y^*_m$, varying between the range Vc to −Vc, to provide an analog display.

The potential which is applied across matrix element $M_{m,n}$ which is shown here as being held in the non-activated state, and across matrix element $M_{m,n+1}$ which is assumed to be in the activated, are shown in FIGS. 6(*e*) and 6(*d*) respectively.

The voltage applied across an activated matrix element is indicated by the full-line portions of FIG. 6(*d*), while the resultant bias voltage appearing across the display element are indicated by the broken-line portions. The bias voltage across this display element following selection of the matrix element in frame interval T1, indicated by numeral 20, (i.e. the activation state holding voltage to which the display element is charged during selection interval $t_{n+1}$) is equal to (Va+Vc−Vth). Similarly, the holding voltage applied across that display element after selection of the matrix element during frame interval T2, indicated by numeral 22, is equal to (−Va−Vc+Vth). It is an essential feature of the present invention that the difference between the maximum potential applied to a matrix element during a selection interval and the holding potential appearing across the display element during the succeeding non-selection interval is equal to or less than the value of threshold voltage Vth of the nonlinear resistance element.

The voltage applied across a non-activated matrix element is shown by the full-line portions in FIG. 6(*e*), while the resultant bias voltage appearing across the display element are indicated by the broken-line portions. The holding voltage produced in this case is equal to (Va−Vc−Vth) during frame interval T1, and (−Va−Vc+Vth) during frame interval T2.

It is a feature of this drive method that, rather than the row scanning signals going to a fixed potential during the non-selection interval portions of a frame interval, (as in the examples of FIG. 4 and FIGS. 5(*d*) and (*e*)), these signals remain at a fixed potential during a non-selection interval following a selection interval, this potential having the same polarity as that during the selection interval, and remain at that potential until the next selection interval, whereupon an inversion of polarity takes place. For example, in the case of drive signal ($\phi^*_{n+1}-\psi^*_m$ the drive signal has a positive polarity during non-selection portion 17 of frame interval T1, and has a negative polarity during non-selection portion 18 of frame interval T2, with the corresponding bias potentials applied to the display element being designated by numerals 20 and 22.

The drive signal waveforms of this embodiment will now be described more specifically. The drive signals applied to the row electrodes are scanning signals which go to the potential Va during odd-numbered selection intervals, go to a potential Vb during odd-numbered non-selection intervals, go to potential −Va during even-numbered selection intervals, and go to potential −Vb during even-numbered non-selection intervals. The drive signals applied to the column electrodes are data signals, which have an absolute value of Vc or less.

It should be noted that although in the above, it is assumed that the row scanning signals remain at a fixed potential (e.g. Vb or −Vb) during the non-selection interval portion of a frame interval following a selection interval, it is only necessary that they remain at such a fixed potential during at least a major portion of the non-selection interval.

The drive signal waveforms of this embodiment of the present invention differ from the prior art with respect to the following points. Firstly, the scanning electrode signal $\phi_n$ is a 3-valued signal, within each of frame intervals T1 and T2, as opposed to the prior art in which both $\phi_n$ and $\phi'_n$ are 2-valued signals. In the prior art examples discussed previously, all of the scanning signals $\phi_1$ to $\phi_N$, $\phi'_1$ to $\phi'_N$ go to a common potential except during the selection intervals $t_n$, $t'_n$. In the case of prior art reference A, the common potential is zero. In the case of prior art reference B the common potential is 0 during T1 and is Vs during T2. With embodiment C of the present invention, on the other hand, the drive signals take potentials Vb and −Vb, rather than a common potential, and the intervals during which these potentials are applied also vary in accordance with the scanning signals. Activation signals and non-activation signals are applied to the display elements of the present invention. For example in FIG. 6(*d*), a signal ($\phi^*_{n+1}-\psi^*_m$) is applied to activate a display element, while a signal shown in the example of FIG. 6(*e*), i.e. signal ($\phi^*_n-\psi^*_m$) is applied to a non-activated display element. The voltage which is applied across a display element during a selection interval will be equal to the maximum effective drive voltage applied during a frame interval (i.e. Va+Vc for an activated display element, and Va−Vc for a non-activated display element) minus the value of the threshold potential Vth.

The drive method according to the present invention will now be evaluated. As for (9) and (10) above, Von and Voff are given by the following equations:

$$Von = Va + Vc - Vth \quad (17)$$

$$Voff = Va - Vc - Vth \quad (18)$$

The condition for ensuring that an activated display element will be held in the activated state, corresponding to condition (1) of the prior art methods, is given by the following:

$$Vth \geqq (Va - Vb + 2Vc) \quad (19)$$

Comparing equations (1) and (19), equation (19) enables Vb to be reduced by an amount equal to Vth. The values of quantities D, F and G defined hereinabove, for this embodiment of the present invention, will be designated as $D_c$, Fc and $G_c$ and are given by the following:

$$D_c = Vth/(Va + Vc - Vth) \quad (20)$$

$$F_c = Vth/(Va + Vc - Vth) \quad (21)$$

$$G_c = 2Va/(Va + Vc - Vth) \quad (22)$$

Each of these quantities can thus take a smaller value than is possible with the prior art examples.

The optimum operating conditions with the present invention are obtained by equating both sides of relationship (19), that is by making:

$$Vth \approx (Va - Vb + 2Vc)/2 \quad (23)$$

In addition, although it is not an essential condition, it is desirable that the potential during the time interval 15 in FIG. 6(*e*), the potential (Va−Vc), be greater than the potential during time interval 16 in FIG. 6(*e*), i.e. the potential (Vb+Vc), in order to ensure reliable establishment of the activation potential condition. That is:

$$Va - Vb \geqq 2Vc \quad (24)$$

Combining equations 19 and 24 above, the following can be obtained:

$$Vth \geqq Va - Vb \geqq 2Vc \quad (25)$$

If the above relationships are interpreted as equations, then the quantities can be expressed as functions of the drive margin M, as follows:

$$D_c = (M-1)/M \quad (26)$$

$$F_c = (M-1)/M \quad (27)$$

$$G_c = (3M-1)/M \quad (28)$$

The relationships between the values of Va, Vb and Vc and the drive margin M, for optimum operation, are given by the following equations (29), (30) and (31):

$$Va \leqq \{(3M-1)/(M-1)\} \cdot Vth/2 \quad (29)$$

$$Vb \leqq \{(M+1)/(M-1)\} \cdot Vth/2 \quad (30)$$

$$Vc \leqq Vth/2 \quad (31)$$

It is also necessary to allow a certain tolerance in the threshold voltage Vth, which will be designated as ΔVth to provide for manufacturing deviations in the value of Vth of the display elements, and the effects of incident light acting on the display elements, etc. This amount of this tolerance can be determined as follows:

$$Va-Vb=(Vth-\Delta Vth)$$

$$Vc=(Vth-\Delta Vth)/2$$

The relationships between the quantities F, D and G (described hereinabove) and the drive margin M for this embodiment, for the case of optimum operating conditions, are illustrated by curves 24, 26 and 28 respectively in FIGS. 7, 8 and 9. These show a considerable improvement by comparison with the improved prior art method A*. The diagrams show the optimum conditions, expressed by equations (26) to (28). Even if these optimum conditions are departed from, such as to establish values for quantities D, E and F which are higher than those lying along curves 24, 26 and 28 in FIGS. 7 to 9, a considerable improvement can still be obtained by comparison with the prior art examples discussed above. The embodiment of the present invention described above will be referred to as drive method C.

It can thus be understood from the above that utilizing the drive method according to the present invention not only enables a considerable improvement to be attained with regard to disadvantages (2) to (4) of the prior art as described above, but also provides an amelioration of disadvantage (1). An example of this will be described for the case of liquid crystal display elements being used. Liquid crystal display elements can be manufactured to operate with a value of Von which is in the range 2 to 10 V. In the case of prior art example A, from conditions (1) and (2) above, since $F \geqq 1.5$, it is necessary to use non-linear elements which have a threshold voltage Vth of 3 to 15 V or more. Elements having such a high value of threshold voltage Vth include varistors, MIM diodes, etc. The manufacturing deviations in the characteristics of ZnO varistors, as given in prior art reference 2, are of the order of ±5 V. Thus, successful operation using such elements as varistors or MIM diodes is difficult to attain, due to the large amount of deviation in the value of threshold voltage Vth. It is possible to obtain a high value of threshold voltage by connecting a large number of silicon diodes in series, and utilizing their forward conduction threshold voltage. This can provide non-linear elements which have a comparatively low amount of stray deviation in Vth, and prior art reference (1) describes an example in which 40 PN diodes are connected in series. However it is almost impossible to form a large number of such elements in each picture element of a display panel, and in addition it would be difficult to attain a sufficiently high manufacturing yield using such a method. Since a high value of Vth is necessary with these prior art examples, it has not been possible to utilize display elements which have good control characteristics. With the present invention however, a value of Vth of the order of 0.6 to 0.7 V provided by a single PN junction, is quite sufficient. For example, satisfactory display quality can be obtained using liquid crystal display elements if Von=2 V, and drive margin M=1.5 V approximately. As can be seen from FIG. 7, these conditions can be satisfied by drive method (C) of the present invention, with Vth=0.35 V, and Von=0.7 V.

Figure 10:
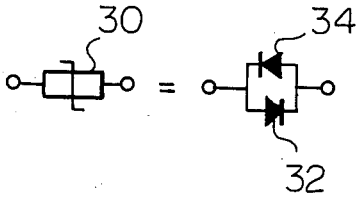
FIG. 10 is a circuit diagram illustrating a non-linear resistance element used in an embodiment of the present invention.

FIG. 10 shows the configuration of a non-linear resistor element 30, used in an embodiment of the present invention. This comprises a pair of silicon diodes 32 and 34, connected in parallel to one another with opposing polarities, in a ring configuration.

Figure 11:
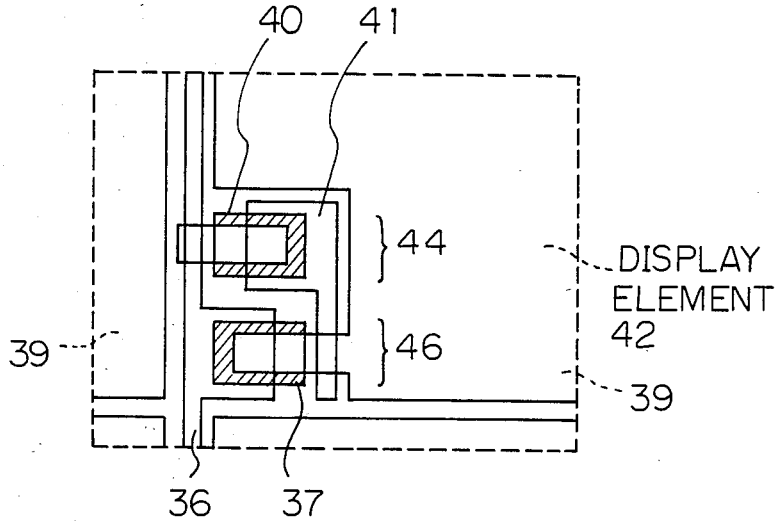
FIG. 11 and FIG. 12 are a plan view and cross-sectional view respectively of a portion of an embodiment of the present invention, corresponding approximately to a single picture element.
Figure 12:
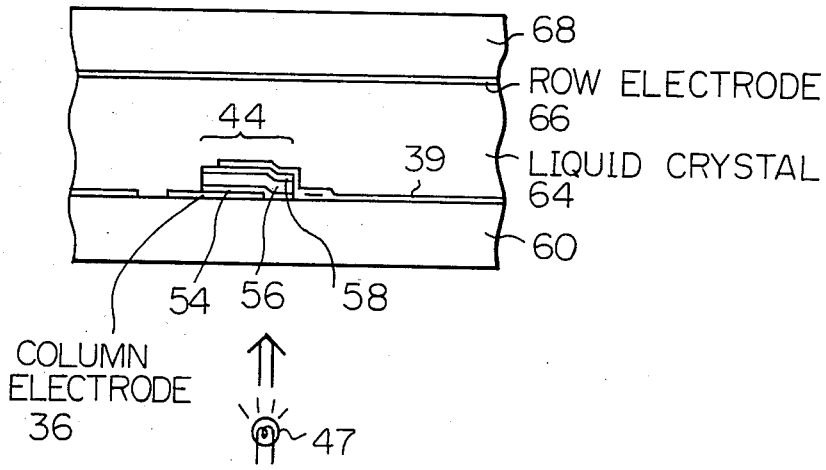
Figure 13:
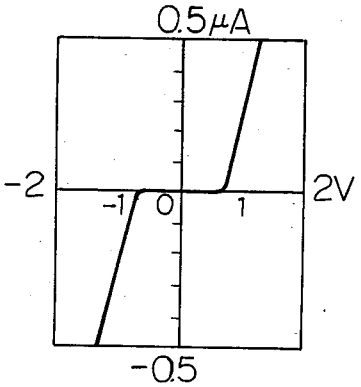
FIG. 13 shows the I-V characteristics of an amorphous silicon diode ring.
Figure 14:
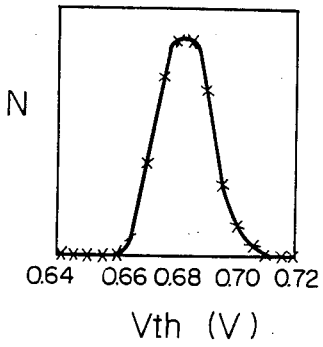
FIG. 14 is a diagram illustrating the distribution of Vth.

FIGS. 11 and 12 are plan and cross-sectional views respectively of this embodiment of the present invention, showing a portion of a display panel substantially corresponding to a single picture element. Numerals 44 and 46 each denote a single amorphous silicon diode, 36 denotes a column electrode, numeral 41 denotes a connecting electrode, numeral 37 and 40 denote amorphous silicon structures, numeral 39 denotes a transparent connecting electrode, numeral 42 denotes a display element, numerals 60 and 68 denote upper and lower substrates respectively, numeral 64 denotes a liquid crystal layer, numeral 66 denotes a row electrode and numerals 54, 56 and 58 respectively denote p+, i (intrinsic), and n+ layers of amorphous silicon. Numeral 47 denotes a light source whose light is incident on the side of the display corresponding to column electrode 36. The I-V characteristics of an amorphous silicon diode ring having the structure described above are shown in FIG. 13. FIG. 14 shows the distribution of Vth for a number of different non-linear elements having the configuration of such an amorphous silicon diode ring. As shown, the values of Vth for most of the elements fall within a range of 40 mv±3%. With the drive method according to the present invention, if the drive margin M=1.2, then D=1/6, so that the manufacturing deviation of Von between different elements will be ±3/6%, i.e. ±0.5%. As a result, extremely uniform display characteristics can be obtained. In addition, the value of peak-to-peak drive voltage required, Vp-p, is independent of the numbers of row electrodes and column electrodes N and M of the matrix, being approximately 4.3 V, so that the display can easily be driven from a 5 V power supply.

Figure 15:
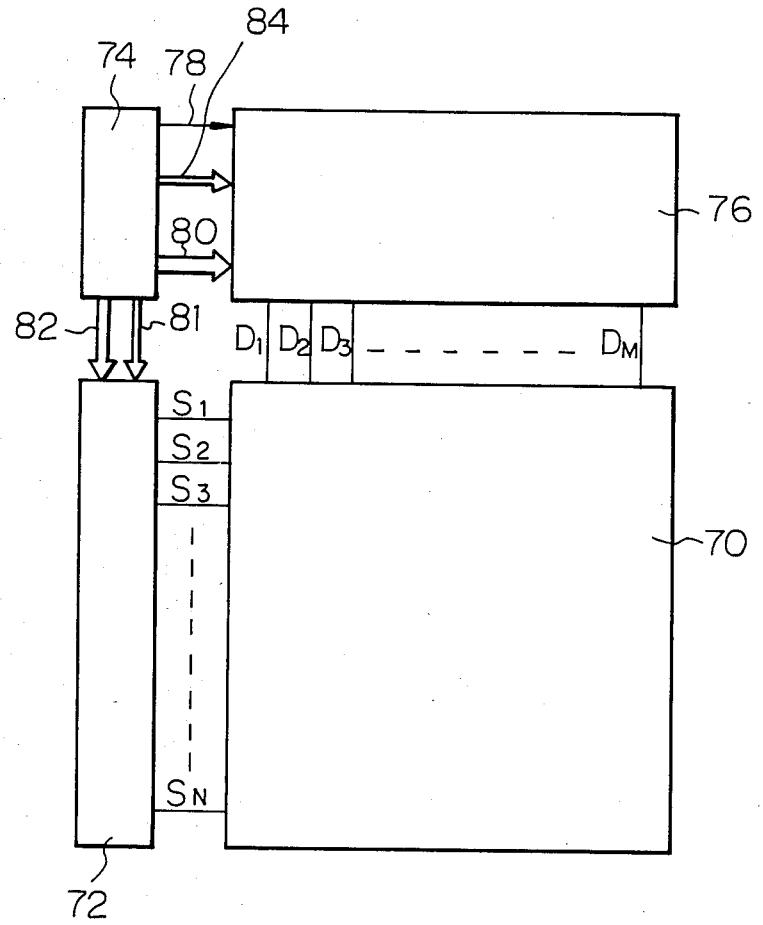
FIG. 15 is a block diagram illustrating a matrix display device suitable for use with the method of the present invention.

FIG. 15 is a block diagram of a matrix display device according to the present invention. Numeral 70 denotes a display panel of the type illustrated in FIG. 12 and FIG. 13, numeral 72 denotes a row electrode drive circuit for applying row drive signals $S_1$ and $S_N$, comprising scanning signals of the form $\phi^*_n$ shown in FIG. 6 to the display panel.

Numeral 76 denotes a column drive circuit for applying column drive signals comprising data signals of the form $Y^*_m$ shown in FIG. 6 to the column electrodes D1 to $D_M$, numeral 74 denotes a controller circuit for supplying to the drive circuits display data signals 78, timing signals 82 and 84, and power supplies 80, 81 etc.

Figure 16:
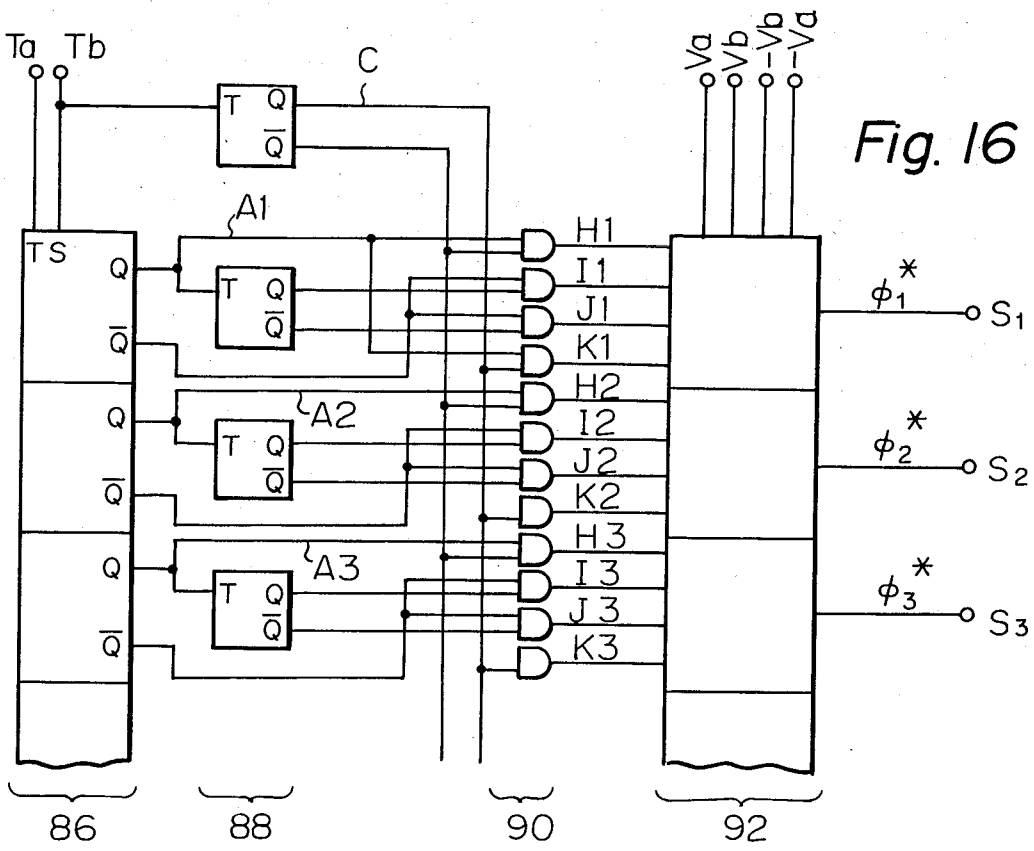
FIG. 16 is a circuit diagram of a scanning signal drive circuit.
Figure 17:
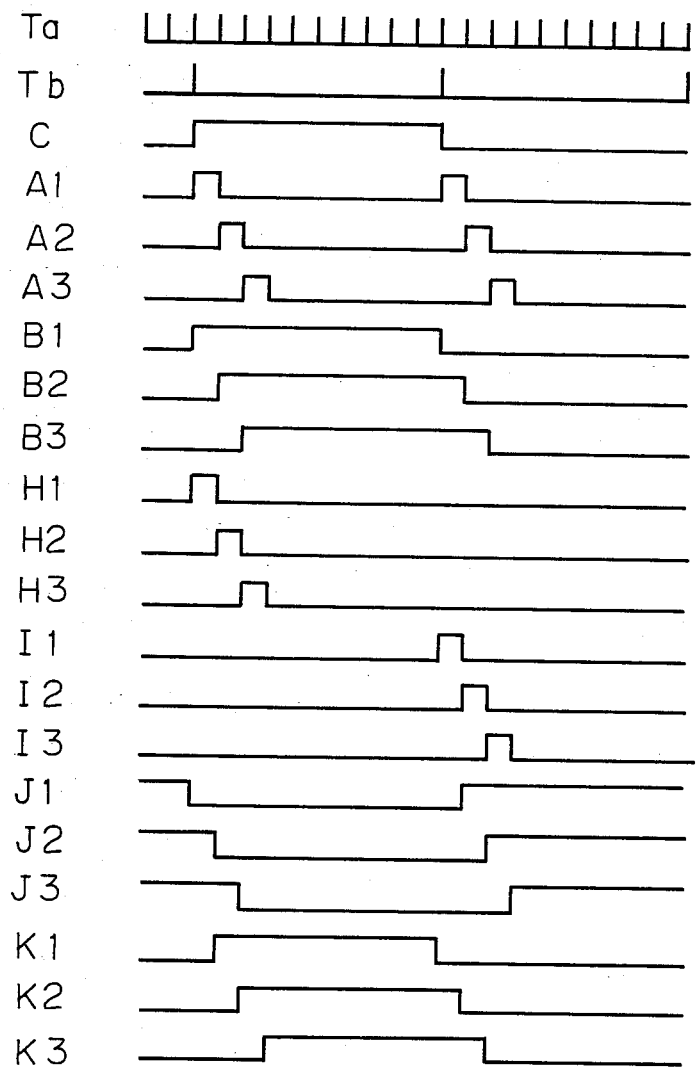
FIG. 17 is a timing chart for the circuit of FIG. 16.

FIG. 16 shows an example of a row electrode drive circuit. FIG. 17 is the corresponding timing chart. Numeral 86 denotes a shift register circuit, numeral 86 denotes a group of latch circuits, numeral 90 denotes a group of AND gates, numeral 92 denotes a group of voltage selector gates for selecting a single potential from among potentials ±Va, ±Vb, in accordance with the signals Hn, In, Jn and Kn, and for supplying the selected signal potential (having the waveform of signal $\phi^*_n$ shown in FIG. 6), to the row electrodes.

Figure 18:
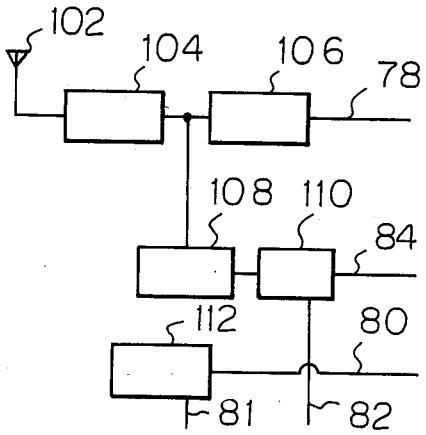
FIG. 18 and FIG. 19 are circuit diagrams of embodiments of a controller circuit and a column electrode drive circuit respectively.

FIG. 18 shows an example of a controller circuit for producing drive signals for an analog type of matrix display device according to the present invention, e.g. a television receiver. Numeral 102 denotes an antenna, numeral 104 denotes a tuner, numeral 106 a video amplifier, numeral 108 denotes a sync separator circuit, numeral 110 denotes a reference pulse generating circuit, and numeral 112 denotes a reference voltage generating circuit.

Figure 19:
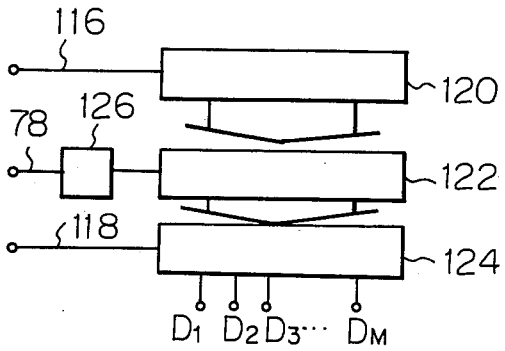
Figure 20:
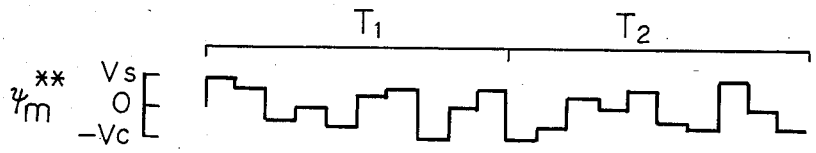
FIG. 20 shows an example of data signals for the case of an analog display device.

FIG. 19 shows an example of a column electrode drive circuit for an analog display type of matrix display device, operating on a line-at-a-time scanning system. Numeral 120 denotes a sampling pulse generating circuit and numerals 122 and 124 denote sample-and-hold circuits. In this example, as opposed to the example of FIG. 6, an analog display signal $Y^{}_m$ varies in a continuous (i.e. non-stepwise) manner between −Vc and Vc, with the polarity of this signal being inverted at the start of successive frame intervals T1 and T2 by means of a polarity inverting circuit 126**.

A large number of display elements, e.g. with 1000 or more rows and columns, can be provided in a matrix display device in accordance with the above embodiments of the present invention, so that the present invention is widely applicable to television receivers, computer terminals etc. The drive margin can be set to the order of 1.5, so that the display quality is significantly better than that of a prior art passive type of matrix display device, and is comparable to that of an active-element type of matrix display device utilizing 3-terminal elements (e.g. thin-film transistors). In addition, the present invention provides significantly greater tolerance against manufacturing deviations in the display element characteristics, by comparison with the prior art, and in addition enables non-linear elements which have a low value of threshold voltage Vth such as amorphous silicon diodes to be utilized. Furthermore, a power supply providing 5 V or less is sufficient to provide power to operate the display device, which is significantly less than the 10 to 30 V power supply voltage that is required by prior art passive matrix or thin-film transistor active matrix displays.

Furthermore, the matrix elements of a matrix display utilizing the method of the present invention can be manufactured by a process which involves only from 3 to 5 layers, shaped by masking steps. Thus, the manufacture of such a display device will require less time than in the case of a matrix display device utilizing thin-film transistors, which requires from 4 to 7 layers. In addition, since an MOS interface is not utilized in the display elements of a display device according to the present invention, a high degree of stability can be attained.

As described above, a display device utilizing the drive method of the present invention possesses significant advantages by comparison with prior art types of display device, e.g. passive types of display device which utilize non-linear resistor elements or active types of display device which utilize transistors, and may very well become the principal type of high-density display to be used in the future.

In the embodiments described above, amorphous silicon diodes are used as the non-linear resistor elements, however it is also possible to use devices such as Schottky barrier diode or MIM diodes to obtain the respective advantages of these devices. In addition, rather than implementing each of the non-linear elements by single stages of diodes, it is equally possible to utilize a plurality of diode stages connected in a series-parallel arrangement for each of these elements. These non-linear elements can also be formed by a multi-layer or a planar configuration. The material for the diodes is not limited to a—Si:H, and it is equally possible to use a—Si:C, a—Si:N, a—Si:O, Cd, CdS, InSb, GaAs, InP, Se, Te, etc. In addition, if a suitable level of control of the characteristics can be attained, it is of course also possible to use varistors or other types of non-linear elements. Furthermore, although liquid crystal is used for the display elements of the above embodiments, it is equally possible to use electrochromic, electro-luminescent, or other types of display element.

Figure 21:
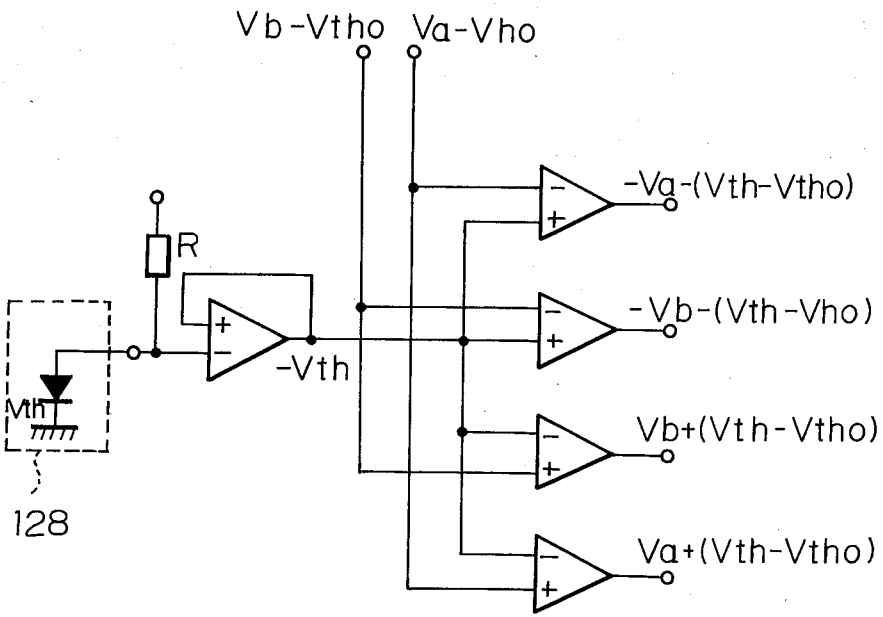
FIG. 21 is a circuit diagram of an embodiment of a circuit for automatically compensating for changes in Vth.

FIG. 21 shows a reference voltage setting circuit for automatically compensating for any changes occurring in the threshold voltage of the non-linear elements. The threshold voltage Vth of a reference non-linear element 128 shown in the diagram is compared with reference potentials (Va−Vth0) and (Vb−Vth0) (where Vth0 is some predetermined nominal value of threshold voltage), such as to automatically adjust the value of Va to become (Va+d'Vth) and adjust Vb to become (Vb+d'Vth), to adjust −Va to become (−Va−d'Vth), and to adjust −Vb to become (−Vb−d'Vth), where d'Vth is equal to (Vth−Vth0). If this is done, then the voltages which are applied to drive the display elements do not change in response to changes in the threshold voltage Vth resulting from operating temperature variations.

Although the method of the present invention has been described in the above with reference to specific embodiments, it should be noted that various changes and modifications to these embodiments may be envisaged, which fall within the scope claimed for the invention, as set out in the appended claims. The above specification should therefore be interpreted in a descriptive and not in a limiting sense.

What is claimed is:

1. A method of driving a matrix display device formed of a plurality of row electrodes, a plurality of column electrodes and a plurality of matrix elements disposed at intersections of said row electrodes and column electrodes, each of said matrix elements comprising an electro-optical display element and a non-linear resistance element connected in series between one of said row electrodes and one of said column electrodes, said non-linear resistance element having a threshold voltage above which a significant increase in the resistance thereof occurs, said method comprising:

applying row scanning signals successively to said row electrodes such that each of said row scanning signals is applied periodically to a corresponding one of said row electrodes during successive scanning frame intervals, while setting each of said row scanning signals to a first potential during a selection interval of fixed duration occurring once during each of said frame intervals and setting each of said row scanning signals to a second potential during a non-selection interval which begins upon termination of each of said selection intervals and continues until the start of the succeeding one of said selection intervals, and setting the absolute value of said first potential to be higher than that of said second potential and setting the polarity of said second potential during each of said non-selection intervals to be identical to the polarity of said first potential during the immediately preceding selection interval; and applying data signals which vary in potential over a fixed range to said column electrodes, said data signals representing data values, while establishing a synchronized relationship between said row scanning signals and said data signals such that a drive potential corresponding to one of said data values is applied to each of said matrix elements during a corresponding one of said selection intervals, wherein the values of said first and second potentials of said row scanning signals and said fixed range of potential variation of said data signals are selected such that the absolute value of the difference between said drive potential established across a matrix element during each of said selection intervals and a potential established across said display element of that matrix element during the immediately preceding non-selection interval is always equal to or less than said threshold voltage of said non-linear resistance elements.

2. A method of driving a matrix display device according to claim 1, and further comprising: performing successive inversions of the polarity of said first potential in successive ones of said selection intervals and successive inversions of the polarity of said second potential in successive ones of said non-selection intervals.

3. A method of driving a matrix display device according to claim 2, wherein said first and second potentials are selected such that when said threshold voltage is designated as Vth, said first potential is designated as Va, said second potential is designated as Vb and said range of variation in potential of said data signals is designated as extending from a potential Vc to a potential −Vc, the relationships between said Vth, Va, Vb and Vc potentials meet the following conditions:

$$(Va-Vb)\leqq Vth$$

$$2Vc\leqq Vth.$$

4. A method of driving a matrix display device according to claim 2, wherein said first and second potentials are selected such that when the maximum value of potential which is applied across each of said display elements is designated as Von, the minimum value thereof is designated as Voff, the ratio Von/Voff is designated as a drive margin M, said threshold voltage is designated as Vth, said first potential is designated as Va, said second potential is designated as Vb and said range of variation in potential of said data signals is designated as extending from a potential Vc to a potential −Vc, the relationships between said Vth, Va, Vb and Vc potentials meet the following conditions:

$$Va\leqq\{(3M-1)/(M-1)\}\cdot Vth/2$$

$$Vb\leqq\{(M+1)/(M-1)\}\cdot Vth/2$$

$$Vc\leqq Vth/2.$$

5. A method of driving a matrix display device according to claim 2 in which an amount of stray deviation of the value of said threshold voltage exists between different ones of said non-linear resistance elements, and wherein the values for said first and second potentials are selected such that when said threshold voltage is designated as Vth, said amount of stray deviation of the value of said threshold voltage is designated as Vth, said first potential is designated as Va, said second potential is designated as Vb and said range of variation in potential of said data signals is designated as extending from a potential Vc to a potential −Vc, the relationships between said Vth, Vth, Va, Vb and Vc meet the following conditions:

$$Va-Vb\cong(Vth-\Delta Vth)$$

$$Vc\cong(Vth-\Delta Vth)/2.$$

6. A method of driving a matrix display device according to claim 2, and further comprising: deriving a voltage which varies in temperature in accordance with variations in the value of said threshold voltage with temperature, producing first and second fixed potentials, comparing said first and second fixed potentials with said temperature-varying voltage, and controlling said first and second potentials of said row scanning signals in accordance with the results of said comparisons with said first and second fixed potentials respectively such as to adjust the values of said first and second potentials to compensate the operation of said matrix display device against changes in said threshold voltage with temperature.

* * * * *